United States Patent [19]

Percebois et al.

[11] Patent Number: 4,669,288

[45] Date of Patent: Jun. 2, 1987

[54] LOCK COMPRISING PREASSEMBLED ELEMENTS

[75] Inventors: Serge Percebois, Chaumont-en-Vexin; Christian Romanek, Noailles, both of France

[73] Assignee: Paul Journee S.A., Courbevoie, France

[21] Appl. No.: 826,518

[22] Filed: Feb. 5, 1986

[30] Foreign Application Priority Data

Feb. 15, 1985 [FR] France ..... 85 02166

[51] Int. Cl.[4] ..... E05B 27/00; E05B 63/00

[52] U.S. Cl. ..... 70/367; 70/364 A; 70/370; 70/371; 70/422

[58] Field of Search ..... 70/364 A, 358, 367, 70/362, 364 R, 369–371, 375, 422

[56] References Cited

U.S. PATENT DOCUMENTS

| | | | |
|---|---|---|---|
| 213,006 | 3/1879 | Taylor | 70/358 |
| 421,205 | 2/1890 | Sykora | 70/358 |
| 913,942 | 3/1909 | Bodge | 70/358 |
| 1,435,682 | 11/1922 | Allain | 70/358 |
| 1,565,557 | 12/1925 | Fremon | 70/358 |
| 1,575,091 | 3/1926 | Best | 70/367 |
| 2,462,954 | 3/1949 | Frizzell | 70/358 |
| 2,922,298 | 1/1960 | Wiener | 70/367 |
| 4,363,230 | 12/1982 | Lipschutz | 70/370 |
| 4,478,061 | 10/1984 | Preddey | 70/358 |

FOREIGN PATENT DOCUMENTS

| | | | |
|---|---|---|---|
| 1553412 | 10/1969 | Fed. Rep. of Germany | 70/358 |
| 1728500 | 10/1973 | Fed. Rep. of Germany | 70/358 |

*Primary Examiner*—Thomas J. Holko
*Assistant Examiner*—Suzanne L. Dino
*Attorney, Agent, or Firm*—Dowell & Dowell

[57] ABSTRACT

A lock assembly comprises a stator, a rotor pivoting in a bore in the stator and a plurality of stator piston/rotor piston pairings which are resiliently urged towards a key channel provided axially in the said rotor for receiving a coded key slidable in said channel and having flats each of which cooperates with one of the said pairings in order to displace the latter against the action of the said resilient means so that the generatrix of separation between each rotor piston and each stator piston of one pairing is at a tangent to the said rotor. The pairs of stator pistons and rotor pistons and their resilient restoring means are preassembled each in a radial bore in the stator. The radial bores are distributed angularly about the axis of the lock in at least one diametrical plane and are closed at their inner end by an abutment which is moved aside during insertion of the rotor. The rotor comprises resilient displaceable abutment means for engagement with said stator to prevent axial movement of the rotor in relation to the stator after entry of said rotor into the stator bore.

3 Claims, 4 Drawing Figures

LOCK COMPRISING PREASSEMBLED ELEMENTS

BACKGROUND TO THE INVENTION

The invention relates to a piston lock of the type comprising a stator, a rotor pivoting in a bore in the stator and a plurality of stator piston-rotor piston pairings which are urged resiliently towards a key channel provided axially in the said rotor, a coded key sliding in the said passage and comprising slats, each of which co-operates with one of the said pairings in order to displace it against the action of the said resilient means in such a way that the plane of separation between each rotor piston and each stator piston of one pairing is tangent to the said rotor.

Such locks have been known since time immemorial. With the development of mass production techniques which are more or less automated, the known locks have the drawback that the combination determined by the pairs of pistons is imposed generally from the outset of manufacture of a lock which comprises such a locking mechanism so that automatic manufacture is very complicated and expensive. In addition, this problem is complicated when it is necessary to produce a plurality of locking mechanisms having the same combination which form a collection. This is particularly the case in the motor vehicle industry when it is desired that a single key operate with the locking mechanisms of doors and/or the anti-theft device and/or the petrol cap and/or the glove compartment and/or the boot.

STATEMENT OF PRIOR ART

In order to resolve this problem, it has been proposed (French Patent No. 79 18918 of 23.7.79) to preassemble the stator and rotor pistons and also their restoring springs in a magazine consisting of two parts, one of which slides in relation to the other. This magazine which comprises the locking mechanism combination is positioned upon completion of assembly and relative sliding of the two parts introduces rotor pistons into the respective bores in the rotor.

This known preassembled locking mechanism which has a marked advantage over conventional locks does however have various drawbacks. First of all, by virtue of its small dimensions and the number of components which it embodies, the magazine is difficult to manufacture, requiring a high degree of precision. Furthermore, as in the majority of piston locks, the axial length which corresponds to the number of pairs of pistons used as a function of the number of different combinations desired is relatively high.

OBJECT OF THE INVENTION

The present invention sets out to provide a piston lock of the type described which permits of preassembly by simple, safe and inexpensive means while providing a short axial length.

SUMMARY OF THE INVENTION

According to the invention there is provided a lock assembly comprising (a) a stator having a bore, (b) a rotor pivoting in said bore over a limited angle of rotation, (c) resilient displaceable abutment means on said rotor for engagement with said stator to prevent axial movement of the rotor in relation to the stator after entry of said rotor into said bore, (d) a plurality of stator piston/rotor piston element pairings movable in radial bores in the stator, (e) resilient means which urge said pairings towards a key channel provided axially in the said rotor for receiving a coded key having flats each of which cooperates with one of said pairings in order to displace the latter against the action of the said resilient means so that the generatrix of separation between each rotor piston and each stator piston element of one pairing is at a tangent to said rotor, said radial bores being distributed angularly about the axis of the lock in at least one diametrical plane, and (f) abutments effecting closure at the inner end of said bores which are moved aside during insertion of the rotor on assembly, said pairings of stator piston and rotor piston elements and their resilient means having been preassembled each in a radial bore in the stator.

With the lock according to the invention, the pairs of pistons are preassembled with an angular offset in relation to one another which permits of a higher assembly volume than with aligned pairs of pistons. Furthermore, the axial length of the lock can be reduced by using only a small number of "layers" of pistons.

In a preferred embodiment, the said radial bores are formed in a piece which is inserted into a lock. Thus it is possible to preassemble the various locks in a collection, prefabricate the corresponding number of inserted pieces which ideally are identical, and having the same combination, and fit the said inserted pieces into their respective lock just prior to the final phase of ratchet engagement of the rotor.

BRIEF DESCRIPTION OF DRAWINGS

The invention will become more easily understood from reading the ensuing description, which is given with reference to the appended drawings, in which.

DESCRIPTION OF PREFERRED EMBODIMENTS

Figure 1:
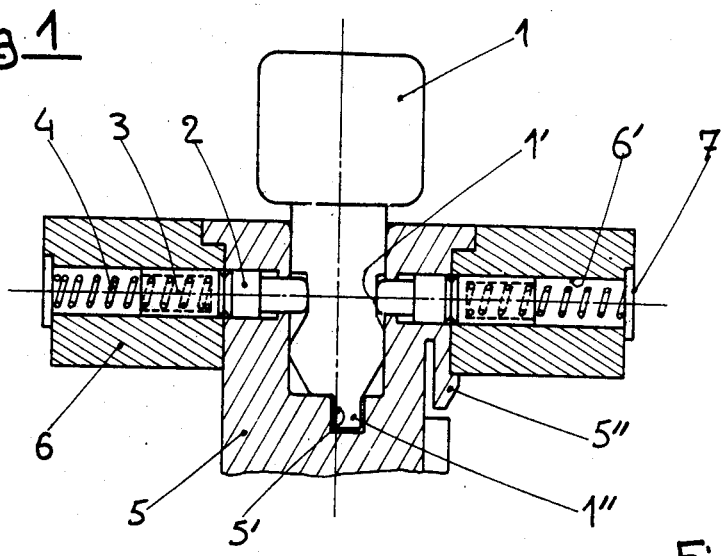
FIG. 1 is a diagrammatic cross-section through a lock according to an embodiment of the invention, the rotor being assembled and the key being engaged in the unlocking position.

The key 1 is provided on its periphery with flats 1' which, in the example illustrated, are disposed in a single axial row or layer. Varying in depth, these flats 1' cooperate in conventional manner with the rotor piston 2/stator piston 3 pairings, each of which pistons is urged by a spring 4 so that in the unlocking position shown in FIGS. 1 and 4 the plane of separation between the pistons 2 and 3 is brought to a position tangent to the periphery of the rotor 5 rendering the latter free to rotate in relation to the stator 6. On the other hand, in the absence of the key (FIG. 2) or with a false key, the plane of separation of all the pistons 2, 3 is not tangent to the rotor 5 and the latter is locked in relation to the stator 6.

In the example illustrated, the key 1 is of generally circular cross-section (apart from the flats 1') and is provided at its free end with an indexing finger 1'' cooperating with a recess 5' of a shape which corresponds to that of the rotor 5 to ensure the position of the key 1 in relation to the rotor 5. In an alternative embodiment, the key 1 may have a non-circular cross-section, the key channel having an identical cross-section.

The pistons 2 and 3 may be replaced by balls of a diameter corresponding to the useful height of the piston.

Figure 2:
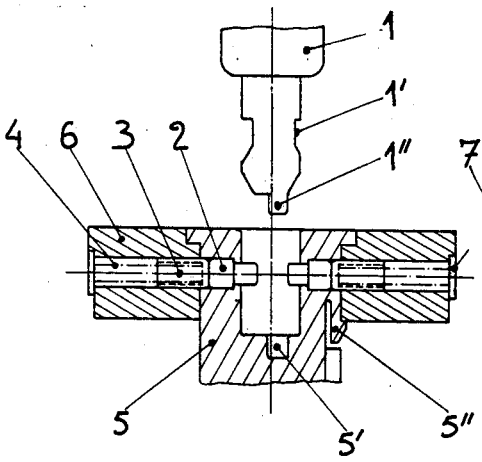
FIG. 2 is similar to FIG. 1, the lock being in the unlocking position.
Figure 3:
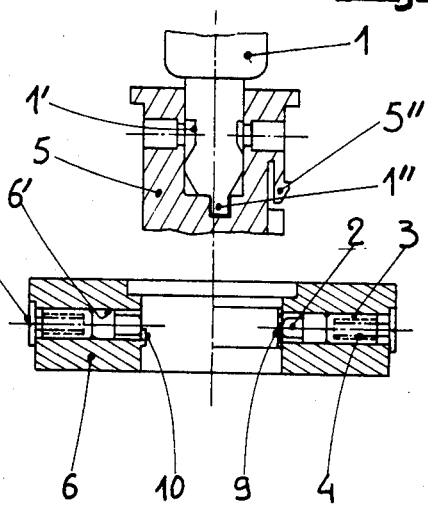
FIG. 3 shows the lock in FIGS. 1 and 2 during assembly of the rotor, the right-hand and left-hand parts representing two alternative forms of inner abutment.
Figure 4:
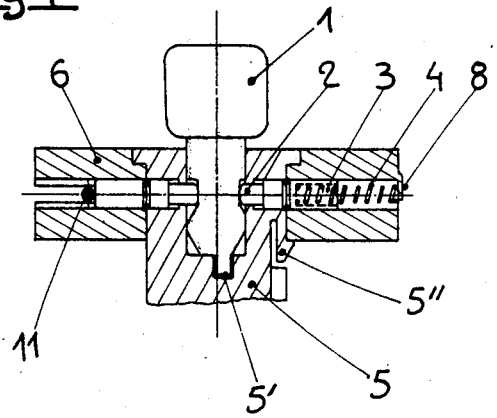
FIG. 4 is identical to FIG. 1, the right and left-hand parts representing two further embodiments of external stop.

In the example illustrated, the stator 6 is an independent member which can be inserted into a lock (not shown). According to the invention, the stator 6 comprises radial bores 6' in each of which are mounted a pair of pistons 2–3 together with their resilient restoring means. Each bore 6' traverses the member 6 and is closed at its outer periphery by a ring 7 common to all the bores 6' over one or a plurality of layers (FIGS. 1 to 3). Alternatively, each bore 6' may be closed by a deformable stud 8 (FIG. 4—right). In both cases, the spring 4 for restoring the pair of pistons 2–3 bears on the abutment 7 or 8.

In an alternative embodiment shown in FIG. 4, on the left, a flexible ring 11 common to all the bores 6' of one and the same layer serves both as a means of external closure of the bore and as a means of restoring the pair of pistons 2–3 into their bore 6'.

At their inner end, the bores 6' are closed by a ring 9 (right-hand part, FIG. 3) common to the bores 6' or by a stud 10 (left-hand part, FIG. 3), which are ejected and/or cut out during engagement of the rotor 5 into its bore in the stator 6.

After insertion, the rotor 5 is located axially in the stator 6, by means of a resilient displaceable member 5'' having hook engaging the stator. The angle of rotation of the rotor within the bore is limited by abutments (not shown).

We claim:

1. A lock assembly comprising (a) a stator having a bore, (b) a rotor pivoting in said bore over a limited angle of rotation, (c) resilient displaceable abutment means on said rotor for engagement with said stator to prevent axial movement of the rotor in relation to the stator after entry of said rotor into said bore, (d) a plurality of stator piston/rotor piston element pairings movable in radial bores in the stator, (e) resilient means which urge said pairings towards a key channel provided axially in the said rotor for receiving a coded key having flats each of which cooperates with one of the said pairings in order to displace the latter against the action of the said resilient means so that the generatrix of separation between each rotor piston and each stator piston element of one pairing is at a tangent to said rotor, said radial bores being distributed angularly about the axis of the lock in at least one diametrical plane, and (f) abutments effecting closure at the inner end of said bores which are moved aside during insertion of the rotor on assembly, said pairings of stator piston and rotor piston elements and their resilient means having been preassembled each in a radial bore in the stator.

2. A lock assembly according to claim 1, wherein said radial bores are formed in a member which is inserted into a lock housing.

3. A lock assembly according to one of claim 1, wherein said radial bores discharge at the outer periphery of the stator and are closed by a ring common at least to the bores in one and the same diametrical plane.

* * * * *